US009963917B2

(12) United States Patent
Reyes Luna

(10) Patent No.: US 9,963,917 B2
(45) Date of Patent: May 8, 2018

(54) HOOD STOP ASSEMBLIES FOR A VEHICLE AND METHODS FOR SETTING A POSITION OF A VEHICLE HOOD

(71) Applicant: FORD GLOBAL TECHNOLOGIES, INC., Dearborn, MI (US)

(72) Inventor: Rodolfo Reyes Luna, Estado de Mexico (MX)

(73) Assignee: Ford Global Technologies, LLC, Dearborn, MI (US)

( * ) Notice: Subject to any disclaimer, the term of this patent is extended or adjusted under 35 U.S.C. 154(b) by 165 days.

(21) Appl. No.: 14/106,296

(22) Filed: Dec. 13, 2013

(65) Prior Publication Data

US 2015/0167359 A1 Jun. 18, 2015

(51) Int. Cl.
*E05C 21/00* (2006.01)
*E05B 83/24* (2014.01)
(Continued)

(52) U.S. Cl.
CPC ..... *E05B 83/24* (2013.01); *E05B 15/0046* (2013.01); *E05B 17/0041* (2013.01); *E05B 77/42* (2013.01); *E05F 5/022* (2013.01); *E05Y 2600/12* (2013.01); *E05Y 2600/314* (2013.01); *Y10T 292/1047* (2015.04)

(58) Field of Classification Search
CPC ..... B62D 25/10; E05B 15/0006; E05B 83/24; E05B 15/0245; E05B 15/0046; E05B 17/0041; E05B 77/42; E05F 5/022; E05F 5/02; E05F 5/025; E05F 5/027; E05F 5/08; E05Y 2600/12; E05Y 2600/314; E05Y 2201/264; Y10T 16/625; Y10T 16/6285; Y10T 24/45225; Y10T 24/45241; Y10T 24/45262; Y10T 24/45529; Y10T 292/03; Y10T 292/0969; Y10T 292/494; Y10T 292/496; Y10T 292/495; Y10T 292/499; Y10T 16/628; F16B 21/08; F16B 21/084; F16B 21/086; Y10S 292/04; Y10S 292/42; Y10S 292/14; Y10S 292/60
USPC ..... 292/1, DIG. 4, DIG. 42, 163, DIG. 14, 292/DIG. 60, 317, 318, 319, 321; 296/193.11, 207; 16/85, 86 R, 86 A;
(Continued)

(56) References Cited

U.S. PATENT DOCUMENTS 1,326,055 A * 12/1919 Hirsch ..... A44C 5/2047 24/616
1,421,388 A * 7/1922 Bippart ..... A44C 5/2047 24/616
(Continued)

FOREIGN PATENT DOCUMENTS

DE 3111622 A1 * 10/1982 ..... F16B 21/086
DE 102006007382 A1 * 8/2007 ..... B60R 13/0206
(Continued)

*Primary Examiner* — Christine M Mills
(74) *Attorney, Agent, or Firm* — Jason Rogers; Brooks Kushman, P.C.

(57) ABSTRACT

Hood stop assemblies and methods of setting a hood of a vehicle to a support frame. The receptacle includes an interior wall that defines a first part of a linear ratchet. The shaft includes a head and a wedge tooth lock that forms a second part of the linear ratchet. The first part of the linear ratchet engages the second part of the linear ratchet in a range of height positions. The methods disclosed relate to setting, adjusting and locking the hood stop.

6 Claims, 5 Drawing Sheets

(51) Int. Cl.

| | |
|---|---|
| ***E05B 15/00*** | (2006.01) |
| ***E05B 17/00*** | (2006.01) |
| ***E05B 77/42*** | (2014.01) |
| ***E05F 5/02*** | (2006.01) |

(58) Field of Classification Search
USPC ..... 180/69.2, 69.21; 411/508–510; 248/27.1, 248/27.3
See application file for complete search history.

(56) References Cited

U.S. PATENT DOCUMENTS 2,912,272 A * 11/1959 Wade ..... E05B 83/24 292/340
3,024,509 A * 3/1962 Hamann ..... F16B 5/06 24/453
3,130,822 A * 4/1964 Meyer ..... F16B 5/123 24/297
4,154,498 A * 5/1979 Wood ..... H02B 1/048 248/27.3
4,639,982 A * 2/1987 Kasai ..... A44B 11/266 24/616
4,713,865 A * 12/1987 Geldwerth ..... A44B 11/266 24/615
4,840,334 A * 6/1989 Kikuchi ..... F16L 3/13 24/453
5,092,550 A * 3/1992 Bettini ..... E05F 5/022 248/188.4
5,735,511 A * 4/1998 Stocker ..... E05F 5/022 248/569
6,039,388 A * 3/2000 Choi ..... E05F 5/022 16/86 R
6,088,878 A * 7/2000 Antonucci ..... E05F 5/022 16/86 A
6,119,306 A * 9/2000 Antonucci ..... E05F 5/022 16/86 A
6,507,976 B2 * 1/2003 Ichimaru ..... E05F 5/022 16/2.1
6,776,566 B2 8/2004 Kobusch et al.
7,114,217 B2 * 10/2006 Matsuzawa ..... E05F 5/022 16/2.2
7,234,569 B2 * 6/2007 Salice ..... E05F 5/006 16/85
7,618,088 B2 * 11/2009 Bauer ..... E05F 5/022 16/82
8,616,622 B2 * 12/2013 Davis ..... B60R 21/34 180/69.2
8,991,537 B2 * 3/2015 Snede ..... E05F 5/022 180/69.2
2004/0025290 A1 * 2/2004 Novarino ..... E05F 5/022 16/86 A
2007/0253796 A1 * 11/2007 Kawai ..... F16B 5/0642 411/508
2008/0298925 A1 * 12/2008 Shinozaki ..... F16B 19/1081 411/48
2009/0169335 A1 * 7/2009 Yuta ..... F16B 19/008 411/431
2011/0014005 A1 * 1/2011 Shinozaki ..... F16B 5/0628 411/347
2012/0108098 A1 * 5/2012 Burris ..... H01R 13/639 439/345

FOREIGN PATENT DOCUMENTS

EP 0611868 A1 * 8/1994 ..... E05F 5/025
EP 1712434 A1 * 10/2006 ..... B60R 21/34
FR 2142200 A5 * 1/1973 ..... F16B 21/086
FR 2764349 A1 * 12/1998 ..... B62D 29/048
FR 2895 435 12/2005
FR 2895435 A1 * 6/2007 ..... E05F 5/022
FR 3002574 A1 * 8/2014 ..... E05F 5/022
FR 3011869 A1 * 4/2015 ..... E05F 5/022

* cited by examiner

HOOD STOP ASSEMBLIES FOR A VEHICLE AND METHODS FOR SETTING A POSITION OF A VEHICLE HOOD

TECHNICAL FIELD

This disclosure relates to a hood stop assembly for setting the flushness of a hood of a vehicle relative to the surrounding vehicle body structure.

BACKGROUND

Referring to FIG. 1, a vehicle 20 is shown with a hood 22 assembled over the engine compartment of the vehicle 20 on a supporting frame. The position of the hood 22 is checked and adjusted to achieve the ideal flushness of the hood 22 relative to the fenders 24 and other surrounding outer body panels. A hood stop 26 permits adjustment of the height of the hood. The hood stop 26 may have a rubber top 28 and a threaded shaft 30. The threaded shaft 30 is assembled to the supporting frame structure of the vehicle 20. The hood stop 26 is rotated to set the hood 22 at a predetermined height. After the hood stop is adjusted, the hood 22 is closed and the height and the height of hood 22 are checked relative to the surrounding outer body panels.

If the hood height is not flush with the surrounding outer body panels, the hood is opened and the height of the hood stop 26 must be readjusted. This process is repeated until the height of the hood 22 is acceptable. In vehicle assembly operations, this procedure for adjusting the height of the hood 22 increases labor costs and assembly time.

The height of the hood stop 26 can be improperly adjusted during a service operation. The height of the hood 22 may need to be readjusted after a front end collision repair.

The above problems and other problems are addressed by this disclosure as summarized below.

SUMMARY

The present disclosure relates to a hood stop assembly for setting a selected height position of a hood of a vehicle relative to a support frame for the hood. The hood stop assembly includes a receptacle attached to the support frame. The receptacle defines an opening, and a plurality of teeth is axially arranged within the opening. The hood stop assembly also includes a stop that has a shaft partially received in the opening and a head at an upper end of the shaft and disposed above the receptacle. The stop has a locking member selectively connecting the stop to the receptacle to fix the shaft to the receptacle with the hood engaging the head at the selected height position. The locking member also has at least one wedge lock tooth that is received in at least one of the plurality of teeth. The hood stop assembly further includes a release operatively connected to the locking member that is actuated to disengage the wedge lock tooth from the plurality of teeth.

The hood stop assembly may include a locking member having a locking projection and the receptacle may further define a slot. The stop is rotatable to engage and disengage the locking projection from the slot. The hood stop assembly may further have a second locking member connected to the stop. The second locking member has a second wedge lock tooth. The receptacle includes a second set of teeth for receiving the second wedge lock tooth. The hood stop assembly may include a biasing device positioned between the stop and the receptacle. The biasing device biases the stop upwardly within the receptacle.

The present disclosure also relates to a hood stop assembly that includes a receptacle attached to the support frame and that defines an opening having a first part of a linear ratchet. The hood stop assembly also includes a stop that has a head on an upper end. The stop is inserted into the opening defined by the receptacle with the head extending above the receptacle to engage the hood in a closed position. The stop includes a second part of the linear ratchet that cooperates with the first part of the linear ratchet. The hood stop assembly also has a spring that biases the stop toward the hood in the closed position. When the hood is moved to a closed position, the stop is pressed into the receptacle. The first part of the linear ratchet and the second part of the linear ratchet are relatively movable to insert the stop further into the receptacle and to resist the withdrawal of the stop from the receptacle. The hood stop assembly further includes a release mechanism operable to release the first part of the linear ratchet from the second part of the linear ratchet to selectively allow the stop to be withdrawn from the receptacle.

The hood stop assembly may have a plurality of teeth that is provided within the opening. The stop may include a wedge lock tooth that engages to one of the plurality of teeth when the stop is pressed into the receptacle. The stop may have a locking projection, and a slot may be provided within the opening. When the stop is rotated, the locking projection is inserted into the slot to prevent the stop from moving vertically.

The present disclosure further relates to a hood stop assembly for a vehicle that includes a head for supporting a hood of the vehicle and a shaft connected to the head. The shaft has a locking projection. The hood stop assembly also has a branch connected to the shaft. The branch includes a plurality of wedge lock teeth. The hood stop assembly further includes a receptacle with the shaft and the branch being moveable within the receptacle. The receptacle has an interior wall that having a linear ratchet for engaging with one of the plurality of the wedge lock teeth. The interior wall includes a slot that is engaged by the locking projection. A spring positioned within the receptacle biases the shaft. When the hood of the vehicle is placed on the head, the shaft presses against the spring and one of the plurality of the wedge lock teeth engages the linear ratchet to set a hood stop position. The hood stop position is lockable by rotating the shaft within the receptacle allowing the locking projection to engage the slot. The hood stop assembly may include a branch that is moveable relative to the shaft to disengage one of the plurality of the wedge lock teeth from the linear ratchet.

The present disclosure relates to a method of setting a hood of a vehicle to a support frame. The method includes the step of connecting a receptacle to the support frame. The receptacle includes an interior wall that defines a first part of a linear ratchet. The method includes the step of inserting a shaft into the receptacle. The shaft includes a head and a wedge tooth lock. The wedge lock tooth forms a second part of the linear ratchet. The method further includes the step of engaging the first part and the second part of the linear ratchet. The shaft may have a locking projection, and the interior wall of the receptacle defines a slot.

The method may include the step of rotating the shaft to insert the locking projection into the slot to further set the hood. The method may include the step of operating a release mechanism to disengage the first part and the second part of the linear ratchet. The method may also include the step of rotating the shaft to release the locking projection from the slot and the step of operating a release mechanism to disengage the first part and the second part of the linear ratchet. The method may also include rotating the shaft to release the locking projection from slot.

The above aspects of this disclosure and other aspects are described below in greater detail with reference to the attached drawings.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
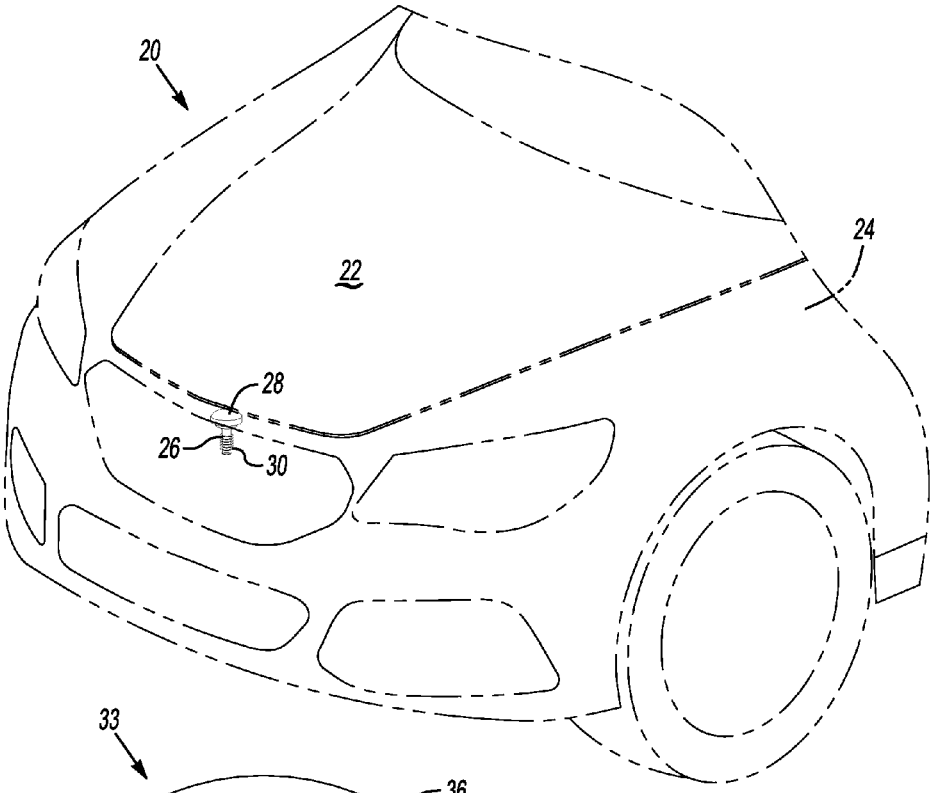
Fig-1 PRIOR ART
FIG. 1 is a fragmentary view of a vehicle with a prior art hood stop.
Figure 3:
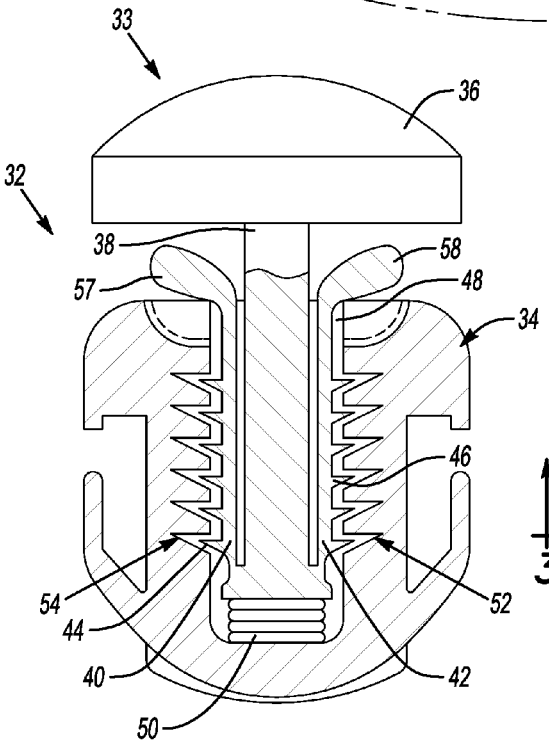
FIG. 3 is a cross-section view of the hood stop assembly taken along the line 3-3 in FIG. 2.
Figure 2:
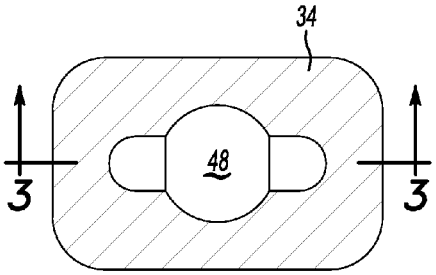
FIG. 2 is a top plan view of a hood stop assembly of the present disclosure.

Referring to FIGS. 2 and 3, a hood stop assembly 32 made according to the embodiment of this disclosure includes a stop 33 and a receptacle 34. The stop 33 has a head 36 contacts and supports the hood of the vehicle. A rubber or a material having a soft surface is provided on the head 36. The stop 33 also includes a shaft 38 partially received in the receptacle 34. A pair of opposing locking members 40 and 42 is attached to the shaft 38. In certain embodiments, only one locking member may be provided. Each locking member 40 or 42 includes at least one wedge lock tooth 44 or 46. A series of axially arranged wedge lock teeth are provided along the edge of the locking member 40, locking member 42, or both to form a part of a linear ratchet. Each locking member 40 or 42 includes a release 57 and 58, respectively. The locking members 40 and 42 are spaced from the shaft 38, except at the bottom of the shaft 38 where the locking members 40 and 42 are attached to the shaft 38.

The receptacle 34 defines an opening 48 that receives the shaft 38 and the locking members 40 and 42. The opening 48 includes an inner wall that defines a first set of teeth 52 and a second set of teeth 54. The first and second sets of teeth are axially aligned on opposite sides of the shaft 38 from each other. In an alternative embodiment, only one set of teeth may be provided. Each set of teeth forms a part of a linear ratchet. A biasing device 50, such as a spring, is positioned in between the shaft 38 and the base of the opening 48 of the receptacle 34. The biasing device 50 biases the shaft 38 out of the receptacle 34.

Figure 4:
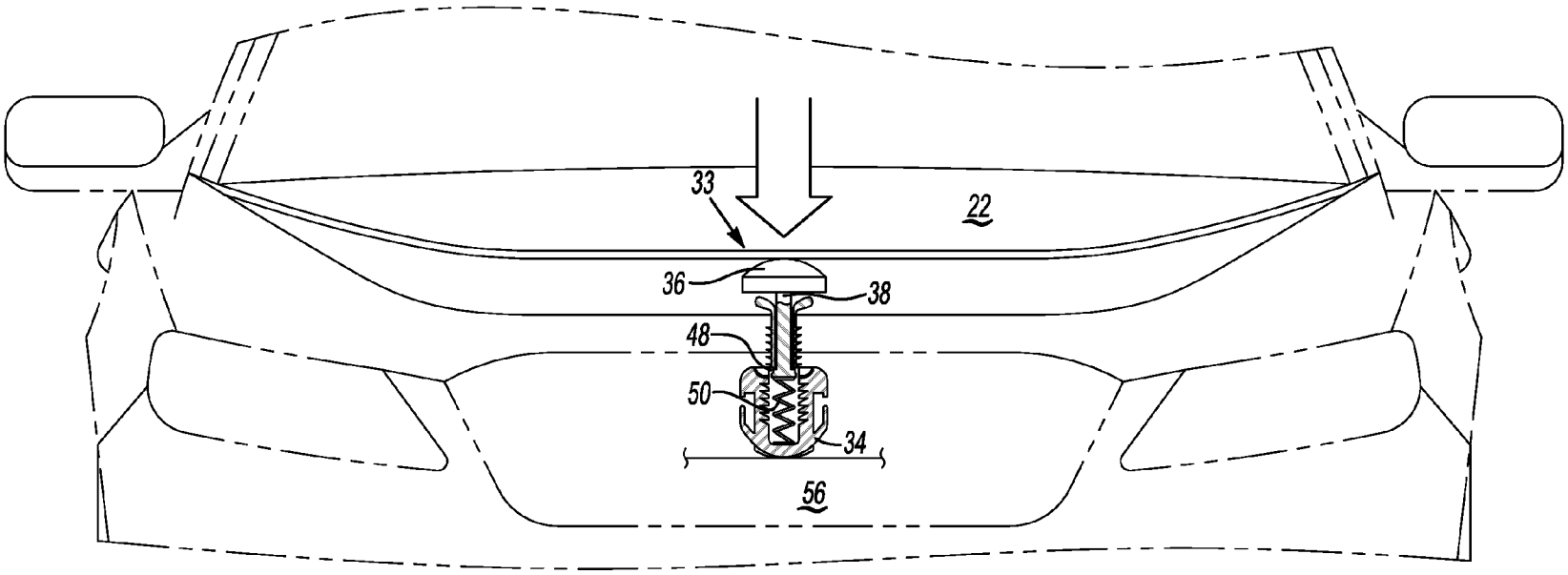
FIG. 4 is a schematic view showing the hood stop assembly with the hood initially engaging the hood stop assembly.
Figure 5:
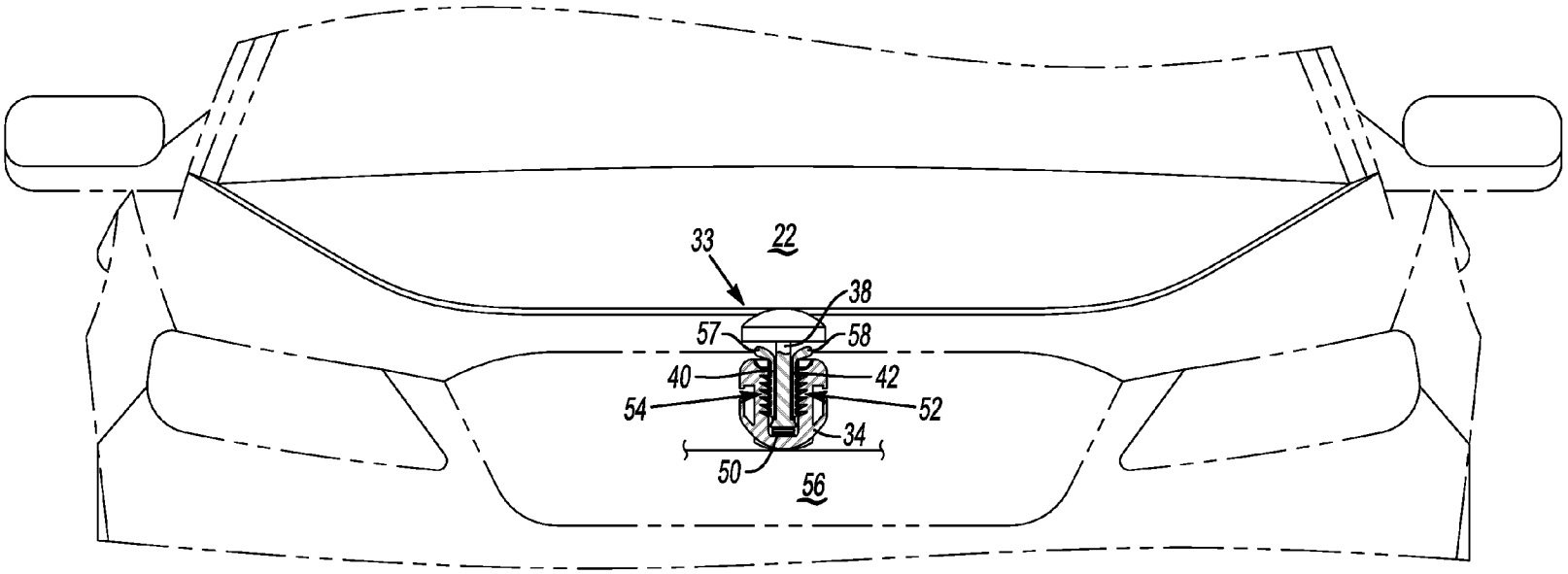
FIG. 5 is a schematic view showing the hood stop assembly with the hood engaging the hood stop assembly with the hood closed.

Referring to FIG. 4, the receptacle 34 is mounted to a support frame 56 of the vehicle, to a fender, or other adjacent structure of the vehicle 20. The shaft 38 is received in the opening 48 of the receptacle 34 and extends outwardly from the receptacle 34. The hood 22 of the vehicle 20 is placed on top of the head 36 of the stop 33. Referring to FIG. 5, the weight of the hood 22 presses the shaft 38 towards the bottom of the receptacle 34. The locking members 40 and 42 and their corresponding plurality of teeth 52 and 54 cooperate as two parts of a linear ratchet. The wedge lock teeth of the locking members 40 and 42 are received by the respective set of teeth 52 or 54 when the shaft 38 is pressed down. The wedge lock tooth is received in a tooth of the receptacle preventing the shaft 38 from moving up because the biasing device 50 presses the wedge lock tooth against the corresponding tooth of the receptacle 34. The shaft 38 may move down if there is space left for the shaft 38 to travel down to the bottom of the receptacle 34.

The height position of the hood 22 relative to the support frame 56 can be adjusted even if the stop 33 is locked by operating the release mechanism. The release 57 and 58 can be pressed towards the shaft 38 to release the wedge lock teeth of the locking members 40 and 42 from the sets teeth of the receptacle 52 and 54. The biasing device 50 pushes against the shaft 38 to extend the shaft 38 away from the receptacle 34. The release mechanism selectively withdraws the stop 33 from the receptacle 34. The steps described above can be repeated until the desired height position of the hood 22 is achieved relative to the support frame 56. The hood stop assembly 32 provides a mechanism for easily and precisely setting and adjusting the height of the hood relative to the support frame of the hood. The hood stop assembly 32 is self-adjusting and provides several height increments for the head with a release mechanism for resetting the height of the hood.

Figure 6:
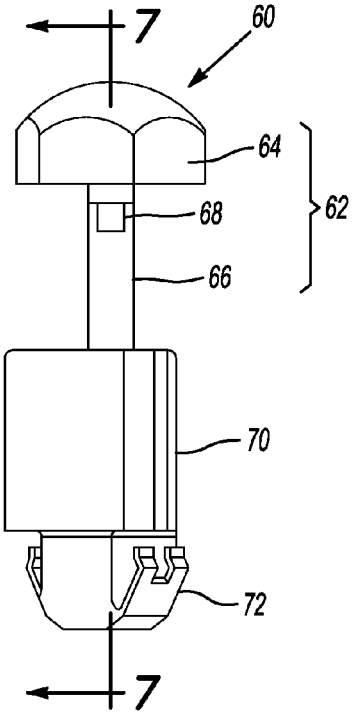
FIG. 6 is a side elevational view of another embodiment of the hood stop assembly in an extended position.

Referring to FIG. 6, another embodiment of a hood stop assembly 60 is illustrated that includes a secondary locking mechanism. The secondary locking mechanism of the hood stop assembly 60 further improves the preciseness and the convenience provided by the self-adjusting feature of the hood stop assembly 60.

The hood stop assembly 60 includes a stop 62 having a head 64 that supports the hood 22. A shaft 66 is attached to the head 64, and a locking branch 68 is provided for setting a selected height position of the hood 22. The hood stop assembly 60 further includes a receptacle 70 that partially receives the shaft 66. A clip 72 is provided below the receptacle 70 to secure the hood stop assembly to a supporting frame, fender, or other adjacent structure of the vehicle.

Figure 7:
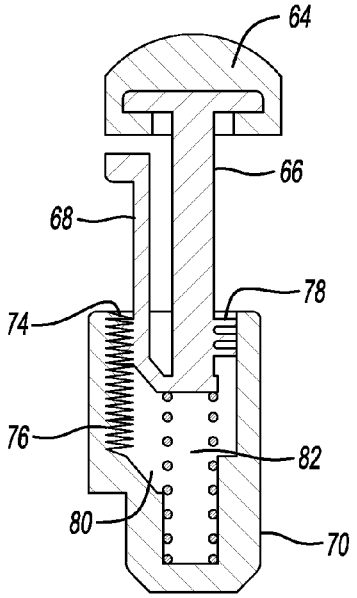
FIG. 7 is a cross-section view of the hood stop assembly of FIG. 6 taken along the line 7-7 in FIG. 6.

Referring to FIG. 7, the lock branch 68 is spaced from the shaft and is connected to the bottom of the shaft 66. A plurality of wedge lock teeth 74 are axially arranged on the lower portion of the lock branch 68. The receptacle 70 defines an opening 80. The opening 80 is asymmetrical to accommodate the lock branch 68 that is attached to only one side of the shaft. The interior wall of the receptacle 70 that aligns with the lock branch 68 defines a plurality of teeth 76 that are adapted to receive the wedge lock teeth 74 of the lock branch 68. The wedge lock teeth 74 of the lock branch 68 are one part of a linear ratchet, and the plurality of teeth 76 of the lock branch 68 serve as the other part of the linear ratchet. A biasing device 82, such as a spring, is also provided between the bottom of the shaft 66 and the receptacle 70. One end of the biasing device 82 is attached to the shaft 66 and the other end of the biasing device 82 is attached to the bottom of the receptacle 70.

Figure 8:
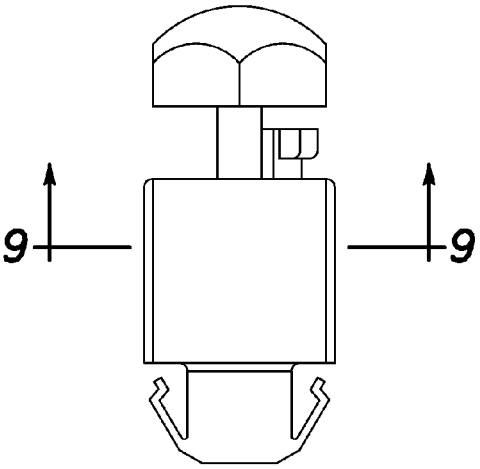
FIG. 8 is a front elevational view of the hood stop assembly of FIG. 6 in a set or contracted position.
Figure 9:
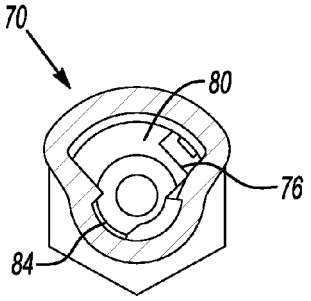
FIG. 9 is a cross-section view of the receptacle of the hood stop assembly of FIG. 6 taken along the line 9-9 in FIG. 8.

The secondary locking mechanism of the hood stop assembly 60 includes a plurality of locking projections 78. The locking projections 78 are axially arranged and attached to the side of the shaft 66 that is opposite the lock branch 68. Referring to FIGS. 8 and 9, the secondary locking mechanism further includes a plurality of slots 84 defined on the interior wall of the receptacle 70 and within the opening 80 for receiving the locking projections 78. The opening 80 is asymmetrical allowing the shaft 66 to be rotated within the opening 80. Rotating the shaft within the opening engages and disengages the plurality of locking projections 78 of the lock branch 68 and the plurality of slots 84 of the receptacle 70.

The hood stop assembly 60 is mounted to a support frame, fender, or adjacent support structure of a vehicle 20. The shaft 66 extends away from the receptacle 70 and is partially received within the receptacle 70. Some of the wedge lock teeth 74 of the lock branch 68 interlock with some of the teeth of the receptacle 70. The biasing device 82 biases the shaft 66 to extend away from the receptacle 70 preventing the shaft 66 from being moved upwards. Without operating the release mechanism, the shaft 66 can only be moved further into the receptacle. The shaft 66 is oriented with the locking projections 78 disengaged with the slots 84 of the receptacle.

Figure 10:
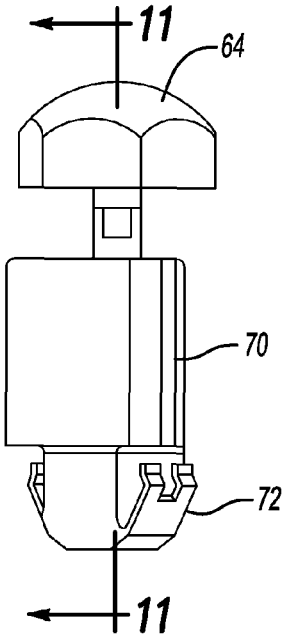
FIG. 10 is a side elevational view of the hood stop assembly of FIG. 6 in a partially locked position.
Figure 11:
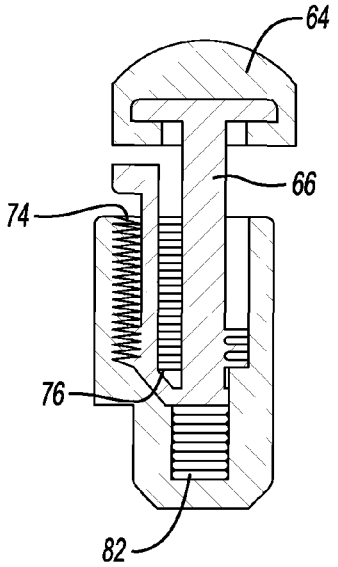
FIG. 11 is a cross-section view of the hood stop assembly of FIG. 6 taken along the line 11-11 in FIG. 10.

Referring to FIGS. 10 and 11, when the hood 22 is in a closed position, the hood is placed on the head 64 and presses the shaft 66 towards the bottom of the receptacle 70. Depending on the weight of the hood 22, additional wedge lock teeth 74 interlock with the teeth 76 to accommodate the added weight until there is no more space for the shaft to travel towards the bottom of the receptacle 70. In FIG. 11, the width of the teeth 76 on the interior wall of the receptacle 70 is sufficient to maintain the interlocking position of the wedge lock teeth 74 when the shaft 66 is rotated.

Figure 12:
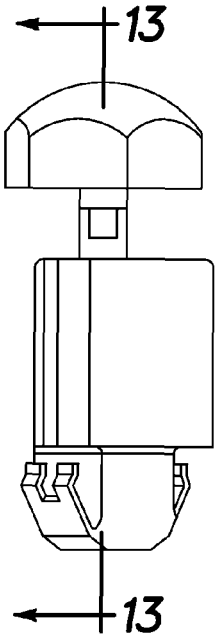
FIG. 12 is a side elevational view of the hood stop assembly of FIG. 6 in a fully locked position.
Figure 13:
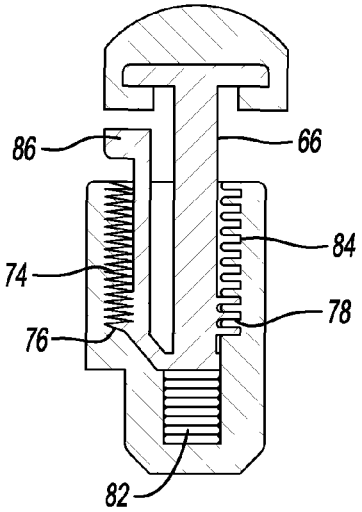
FIG. 13 is a cross-section view of the hood stop assembly of FIG. 6 taken along the line 13-13 in FIG. 12.

Referring to FIGS. 12 and 13, once the desired height position of the hood relative to the support frame is achieved, the shaft 66 can be rotated to engage the secondary locking mechanism. The secondary locking mechanism is engaged when the locking projections 78 are inserted into the plurality of slots 84. The hood stop assembly 60 provides a way to easily, precisely, and flexibly adjust and set the hood position. The linear ratchet allows the hood to be adjusted in height in a range of increments. The linear ratchet and the secondary locking mechanism rigidly set the hood position. The height of the hood relative to the support frame can be reset by opening the hood and rotating the shaft 66 to disengage the locking projections 78 from the slots 84. The lock branch 68 includes a release 86 that can be pressed against the shaft 66. The wedge lock teeth 74 disengage the teeth 76 by pressing the release 86 against the shaft 66. The biasing device 82 pushes the shaft 66 to extend the shaft away from the receptacle 70 moving the shaft toward the starting position, as shown in FIG. 7.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A hood stop assembly comprising:

a hood for closing an engine compartment opening defined by a vehicle;

a receptacle attached to the vehicle adjacent the engine compartment opening defining an opening having an axis the receptacle including a plurality of receptacle teeth;

a stop including:

a shaft having a first shaft end and a second shaft end, the first shaft end inserted in the opening and the second shaft end adjacent to the hood when the hood is in a closed position;

an arm having a first arm end and a second arm end, the second arm end being radially outwardly spaced from the shaft and the first arm end being attached to the first shaft end within the opening and including locking teeth received by the plurality of receptacle teeth;

a biasing device positioned between the second shaft end and the receptacle and biasing the shaft toward the hood; and a release extending from the second arm end and positioned between the hood and the receptacle, wherein the release is compressed outside the opening towards the shaft to disengage the locking teeth from the plurality of receptacle teeth;

wherein the stop is pressed into the receptacle by moving the hood to the closed position with the locking teeth being movable relative to the plurality of receptacle teeth to insert the stop further into the receptacle and resist withdrawal of the stop from the receptacle.

2. The hood stop assembly of claim 1, further comprising a second arm radially outwardly spaced from the shaft with a second end of the second arm attached to the shaft within the opening, the second arm having a second set of locking teeth, the receptacle further including a second set of receptacle teeth for receiving the second set of locking teeth.

3. The hood stop assembly of claim 1, wherein the second arm end is spaced from the shaft to allow the arm to move relative to the shaft, wherein when the arm is moved towards the shaft, the locking teeth of the arm disengage from the plurality of receptacle teeth.

4. The hood stop assembly of claim 1, wherein each tooth of the plurality of receptacle teeth and the locking teeth includes a back edge, arranged orthogonally to the axis, and a front edge arranged along an acute angle with respect to the axis and wherein the back edges and the front edges of the plurality of receptacle teeth and the locking teeth form a linear ratchet.

5. A hood stop assembly for a hood of a vehicle comprising:

a hood of a vehicle;

a receptacle attached to a support frame of the vehicle, the receptacle including a top surface that defines an opening, wherein a first part of a linear ratchet is provided within the opening;

a stop including a head extending from an upper end of a shaft, wherein the shaft is inserted into the opening defined by the receptacle with the head extending above the top surface of the receptacle to engage the hood in a closed position of the hood, wherein the shaft includes a second part of the linear ratchet that cooperates with the first part of the linear ratchet, wherein a space is defined between the second part of the linear ratchet and the upper end of the shaft in a first position;

a spring biasing the stop toward the hood in the closed position, wherein the stop is pressed into the receptacle by moving the hood to the closed position with the first part of the linear ratchet and the second part of the linear ratchet being relatively movable to insert the stop further into the receptacle and resisting withdrawal of the stop from the receptacle; and a release mechanism provided on the second part of the linear ratchet, disposed between the head and the top surface of the receptacle so that a user may move the release mechanism towards the shaft to press the second part of the linear ratchet against the shaft in a second position to selectively withdraw the stop from the receptacle.

6. The hood stop assembly of claim 5, wherein the first part of the linear ratchet comprises receptacle teeth provided within the opening, the second part of the linear ratchet including locking teeth that disengage the receptacle teeth when the second part of the linear ratchet is pressed against the shaft.

* * * * *